US012187971B2

(12) United States Patent
Gilbert

(10) Patent No.: US 12,187,971 B2
(45) Date of Patent: Jan. 7, 2025

(54) SECONDARY FLUID FOR ENGINES

(71) Applicant: Coolcharge Pty Ltd., Maitland (AU)

(72) Inventor: Murdoch Leonard Gilbert, Maitland (AU)

(73) Assignee: Coolcharge Pty Ltd., Maitland (AU)

( * ) Notice: Subject to any disclaimer, the term of this patent is extended or adjusted under 35 U.S.C. 154(b) by 0 days.

(21) Appl. No.: 18/260,629

(22) PCT Filed: Jan. 7, 2022

(86) PCT No.: PCT/AU2022/050004
§ 371 (c)(1),
(2) Date: Jul. 7, 2023

(87) PCT Pub. No.: WO2022/147597
PCT Pub. Date: Jul. 14, 2022

(65) Prior Publication Data

US 2024/0059993 A1 Feb. 22, 2024

(30) Foreign Application Priority Data

Jan. 7, 2021 (AU) ..... 2021900021

(51) Int. Cl.
*C10L 1/32* (2006.01)
*C10L 10/08* (2006.01)

(52) U.S. Cl.
CPC ..... *C10L 1/32* (2013.01); *C10L 10/08* (2013.01); *C10L 2200/0254* (2013.01); *C10L 2200/0295* (2013.01); *C10L 2270/026* (2013.01)

(58) Field of Classification Search
CPC ..... C10L 1/1802; C10L 1/32; C10L 1/328; C10L 10/02; C10L 10/06; C10L 10/08; C10L 2200/0254; C10L 2200/0295; C10L 2200/0484; C10L 2230/22; C10L 2250/082; C10L 2250/086; C10L 2270/023; C10L 2270/026; C10L 2290/24; F02D 19/0655;
(Continued)

(56) References Cited

U.S. PATENT DOCUMENTS 4,333,739 A 6/1982 Neves
4,929,252 A 5/1990 Brillhart
(Continued)

FOREIGN PATENT DOCUMENTS

CN 103525485 A 1/2014
EP 2208879 B1 * 11/2011 ..... C10L 1/328
(Continued)

OTHER PUBLICATIONS

UA-100995-C2 google translation (Year: 2013).*
(Continued)

*Primary Examiner* — Ellen M McAvoy
*Assistant Examiner* — Chantel Graham
(74) *Attorney, Agent, or Firm* — Sisson & Banyas, Attorneys at Law, LLC; Jeffrey J. Banyas

(57) ABSTRACT

A secondary fluid is provided for use in an internal combustion engine that burns a primary fuel. The secondary fluid comprises about 15 vol % to about 30 vol % of alcohol; and about 0.0025 vol % to about 0.5 vol % of a lubricity enhancer which optionally is a castor oil. The secondary fluid is a thermodynamically stable microemulsion with water being the continuous phase.

20 Claims, 7 Drawing Sheets

| | Standard | CC-M | CC-E | CC-M+H2 Gas | CC-E+H2 Gas |
|---|---|---|---|---|---|
| O2 | 10.85% | 10.57% | 11.05% | 10.70% | 11.09% |
| CO2 | 7.52% | 7.68% | 7.29% | 7.09% | 6.83% |
| NO | 268 ppm | 154 ppm | 144 ppm | 142 ppm | 135 ppm |
| NO2 | 2 ppm | 2 ppm | 2 ppm | 7 ppm | 5 ppm |
| NOx | 270 ppm | 156 ppm | 146ppm | 149 ppm | 140 ppm |
| N2O | 136 ppm | 156 ppm | 0 ppm | 237 ppm | 0 ppm |

(58) Field of Classification Search
CPC .... F02D 19/12; F02M 25/0228; H05K 1/117; H05K 3/3405; H05K 3/3447
See application file for complete search history.

(56) References Cited

U.S. PATENT DOCUMENTS

| | | | | |
|---|---|---|---|---|
| 6,302,929 | B1 | 10/2001 | Gunnerman | |
| 7,276,093 | B1 * | 10/2007 | Rivas | C10L 1/32 516/29 |
| 9,175,199 | B2 | 11/2015 | Meyer-Pittroff | |
| 9,493,709 | B2 * | 11/2016 | Goerz, Jr. | F02M 27/042 |
| 9,840,975 | B2 | 12/2017 | Surnilla et al. | |
| 2017/0081606 | A1 * | 3/2017 | Wang | C10L 10/12 |

FOREIGN PATENT DOCUMENTS

| | | | | |
|---|---|---|---|---|
| UA | 100995 | C2 * | 2/2013 | |
| WO | WO-2017010993 | A1 * | 1/2017 | C09K 8/03 |

OTHER PUBLICATIONS

EP-2208879-B1 google translation (Year: 2011).*
Comment by BLACK_HAT on forums.pelicanparts.com [Viewed on internet on Mar. 17, 2022] < URL: http://forumspelicanparts.com/911-930-turbo-super-charging-forum/1056201-whos-meth-user-water-methanol-injection.html#post10801161>. Published on Mar. 28, 2020. whole document.
Pinzi, S. et al. "Castor oil enhanced effect on fuel ethanol-diesel fuel blend properties." Applied Energy 224 (2018): 409-416.
Pashley, R. M., Francis, M.J., and Rzechowicz, M. "The hydrophobicity of non-aqueous liquids and their dispersion in water under degassed conditions." Current opinion in colloid & interface science 13 (2008): 236-244.
Liang, J. et al. "Span80/Tween80 stabilized bio-oil-in-diesel microemulsion: Formation and combustion." Renewable Energy 126 (2018): 774-782.
Hassan, H. A., Rizalman, M., and Hagos, F.Y. "Reductions of Particulate Matter Emissions of a Diesel Engine Fueled with Oxygenated and Emulsion Fuels." Journal of Biobased Materials and Bioenergy 13 (2019): 764-777.

* cited by examiner

| | Standard | CC-M | CC-E | CC-M+H2 Gas | CC-E+H2 Gas |
|---|---|---|---|---|---|
| O2 | 10.85% | 10.57% | 11.05% | 10.70% | 11.09% |
| CO2 | 7.52% | 7.68% | 7.29% | 7.09% | 6.83% |
| NO | 268 ppm | 154 ppm | 144 ppm | 142 ppm | 135 ppm |
| NO2 | 2 ppm | 2 ppm | 2 ppm | 7 ppm | 5 ppm |
| NOx | 270 ppm | 156 ppm | 146ppm | 149 ppm | 140 ppm |
| N2O | 136 ppm | 156 ppm | 0 ppm | 237 ppm | 0 ppm |

Figure 1

| | Standard | CC-M | CC-E | CC-M+H2 Gas | CC-E+H2 Gas |
|---|---|---|---|---|---|
| O2 | 7.49% | 7.02% | 8.47% | 7.27% | 7.30% |
| CO2 | 9.87% | 10.19% | 9.12% | 9.59% | 9.51% |
| NO | 403 ppm | 253 ppm | 223 ppm | 190 ppm | 191 ppm |
| NO2 | 5 ppm | 1 ppm | 3 ppm | 1 ppm | 2 ppm |
| NOx | 408 ppm | 254 ppm | 226ppm | 191 ppm | 193 ppm |
| N2O | 142 ppm | 119 ppm | 1 ppm | 108 ppm | 3 ppm |

Figure 2

| | Standard | CC-E | RO Water |
|---|---|---|---|
| O2 | 13.58% | 13.87% | 14.49% |
| CO2 | 5.37% | 5.03% | 4.81% |
| NO | 117 ppm | 55 ppm | 82 ppm |
| NO2 | 3 ppm | 5 ppm | 2 ppm |
| NOx | 120 ppm | 60 ppm | 84 ppm |
| N2O | 5 ppm | 6 ppm | 0ppm |

Figure 3

| | Standard | CC-E | RO Water |
|---|---|---|---|
| O2 | 14.82% | 14.34% | 15.26% |
| CO2 | 4.59% | 4.91% | 4.30% |
| NO | 98 ppm | 45 ppm | 99 ppm |
| NO2 | 4 ppm | 16 ppm | 14 ppm |
| NOx | 102 ppm | 61 ppm | 113ppm |
| N2O | 0 ppm | 1 ppm | 0 ppm |

Figure 4

| Injected fluid | Standard Engine | CC-E | CC-E EGR Disabled | CC-E EGR Disabled +H2 Gas | CC-M | CC-M EGR Disabled | CC-M EGR Disabled +H2 Gas |
|---|---|---|---|---|---|---|---|
| RPM | 1560 | 1660 | 1660 | 1780 | 1660 | 1560 | 1800 |
| O2 | 17.04% | 16.76% | 17.68% | 17.47% | 16.87% | 17.83% | 17.52% |
| CO2 | 3.13% | 3.20% | 2.51% | 1.99% | 3.16% | 2.47% | 1.93% |
| NO | 40 ppm | 2 ppm | 3 ppm | 0 ppm | 0 ppm | 1 ppm | 0 ppm |
| NO2 | 27 ppm | 27 ppm | 32 ppm | 31 ppm | 28 ppm | 39 ppm | 32 ppm |
| NOx | 67 ppm | 29 ppm | 35 ppm | 31 ppm | 28 ppm | 40 ppm | 32 ppm |
| N2O | 0 ppm | 15 ppm | 8 ppm | 9 ppm | 17 ppm | 6 ppm | 7 ppm |

Figure 5

| Injected fluid | Standard Engine | CC-E | CC-E EGR Disabled | CC-E EGR Disabled +H2 Gas | CC-M | CC-M EGR Disabled | CC-M EGR Disabled +H2 Gas |
|---|---|---|---|---|---|---|---|
| RPM | 2480 | 2480 | 2420 | 2540 | 2530 | 2440 | 2600 |
| O2 | 16.16% | 16.07% | 17.07% | 16.90% | 16.06% | 17.12% | 16.88% |
| CO2 | 3.75% | 3.72% | 2.94% | 2.69% | 3.74% | 2.94% | 2.64% |
| NO | 28 ppm | 0 ppm | 0 ppm | 0 ppm | 0 ppm | 0 ppm | 0 ppm |
| NO2 | 28 ppm | 28 ppm | 37 ppm | 34 ppm | 31 ppm | 40 ppm | 36 ppm |
| NOx | 56 ppm | 28 ppm | 37 ppm | 34 ppm | 31 ppm | 40 ppm | 36 ppm |
| N2O | 0 ppm | 20 ppm | 10 ppm | 9 ppm | 12 ppm | 1 ppm | 0 ppm |

Figure 6

| Fluid tested | Standard Engine | CC-M | CC-E |
|---|---|---|---|
| Engine air mass | 55 g/s | 56.5 g/s | 55.1 g/s |
| Intake manifold °C | 109.7 | 77.5 | 73.8 |
| Exhaust manifold °C | 521 | 488 | 477 |
| Throttle position | 52.80% | 50.70% | 48.10% |
| RPM | 2902 | 2899 | 2901 |

Figure 7

| Fluid tested | Standard Engine | CC-M | CC-E |
|---|---|---|---|
| Engine air mass | 56.9 g/s | 56.3 g/s | 54.7 g/s |
| Intake manifold °C | 121.3 | 84.8 | 82.3 |
| Exhaust manifold °C | 633 | 612 | 599 |
| Throttle position | 62.90% | 62.70% | 61.90% |
| RPM | 2903 | 2901 | 2900 |

Figure 8

| | Torque NM | Power KW | Measured increase power KW | Measured increase Torque NM |
|---|---|---|---|---|
| Standard | 324NM | 63KW | - | - |
| CC-M | 353NM | 68.5KW | 5KW | 29NM |
| CC-E | 329NM | 65KW | 2KW | 5NM |

Figure 9

5ml Ethanol 95ml RO degassed Water + Synthetic Castor oil

| Time | 1 Hour | 12 Hours | 1 week | 1 Month | Foaming |
|---|---|---|---|---|---|
| 5ml Ethanol 95ml RO degassed water 1ml Synthetic Castor oil | Failed -Oil on surface | - | - | - | Yes |
| 5ml Ethanol 95ml RO degassed water 0.5ml Synthetic castor oil | Failed -Oil on surface | - | - | - | Yes |
| 5ml Ethanol 95ml RO degassed water 0.25ml Synthetic Castor oil | Failed -Oil on surface | - | - | - | Yes -Slight foaming |
| 5ml Ethanol 95ml RO degassed water 0.05ml Synthetic Castor oil | Passed -Slight oil on surface | Passed -Oil on surface | Failed -Oil on surface | - | Yes -Very slight foaming |

Figure 10

19ml Ethanol 81ml RO degassed Water + Synthetic Castor oil

| Time | 1 Hour | 12 Hours | 1 week | 1 Month | Foaming |
|---|---|---|---|---|---|
| 19ml Ethanol 81ml RO degassed water 1ml Synthetic Castor oil | Failed -Oil on surface | - | - | - | NO |
| 19ml Ethanol 81ml RO degassed water 0.5ml Synthetic castor oil | Failed -Oil on surface | - | - | - | NO |
| 19ml Ethanol 81ml RO degassed water 0.25ml Synthetic Castor oil | Passed -Slight oil on surface | Passed -Slight oil on surface | Passed -Slight oil on surface | Failed -Oil on surface | NO |
| 19ml Ethanol 81ml RO degassed water 0.05ml Synthetic Castor oil | Passed -Very slight oil on surface | Passed -Very slight oil on surface | Passed -Very slight oil on surface | Passed Slight oil on surface | NO |

Figure 11

60ml Ethanol 40ml RO degassed Water + Synthetic Castor oil

| Time | 1 Hour | 12 Hours | 1 week | 1 Month | Foaming |
|---|---|---|---|---|---|
| 60ml Ethanol 40ml RO degassed water 1ml Synthetic Castor oil | Failed -Oil settlement | - | - | - | YES |
| 60ml Ethanol 40ml RO degassed water 0.5ml Synthetic castor oil | Failed -Oil settlement | - | - | - | YES |
| 60ml Ethanol 40ml RO degassed water 0.25ml Synthetic Castor oil | Failed -Oil Settlement | - | - | - | YES |
| 60ml Ethanol 40ml RO degassed water 0.05ml Synthetic Castor oil | Passed | Passed | Passed -Slight Oil settlement | Failed -Oil Settlement | YES Slight foaming |

Figure 12

5ml Methanol 95ml RO degassed Water + Synthetic Castor oil

| Time | 1 Hour | 12 Hours | 1 week | 1 Month | Foaming |
|---|---|---|---|---|---|
| 5ml Methanol 95ml RO degassed water 1ml Synthetic Castor oil | Failed -Oil on surface | - | - | - | Yes |
| 5ml Methanol 95ml RO degassed water 0.5ml Synthetic castor oil | Failed -Oil on surface | - | - | - | Yes |
| 5ml Methanol 95ml RO degassed water 0.25ml Synthetic Castor oil | Failed -Oil on surface | - | - | - | Yes -Slight foaming |
| 5ml Methanol 95ml RO degassed water 0.05ml Synthetic Castor oil | Passed -Slight oil on surface | Passed -Slight oil on surface | Failed -Oil on surface | - | Yes -Very slight foaming |

Figure 13

23ml Methanol 77ml RO degassed Water + Synthetic Castor oil

| Time | 1 Hour | 12 Hours | 1 week | 1 Month | Foaming |
|---|---|---|---|---|---|
| 23ml Methanol 81ml RO degassed water 1ml Synthetic Castor oil | Failed -Oil on surface | - | - | - | NO |
| 23ml Methanol 81ml RO degassed water 0.5ml Synthetic castor oil | Failed -Oil on surface | - | - | - | NO |
| 23ml Methanol 81ml RO degassed water 0.25ml Synthetic Castor oil | Passed -Slight oil on surface | Passed -Slight oil on surface | Passed -Slight oil on surface | Failed -Oil on surface | NO |
| 23ml Methanol 81ml RO degassed water 0.05ml Synthetic Castor oil | Passed | Passed | Passed -Very slight oil on surface | Passed -Very slight oil on surface | NO |

Figure 14

60ml Methanol 40ml RO degassed Water + Synthetic Castor oil

| Time | 1 Hour | 12 Hours | 1 week | 1 Month | Foaming |
|---|---|---|---|---|---|
| 60ml Methanol 40ml RO degassed water 1ml Synthetic Castor oil | Failed -Oil settlement | - | - | - | YES |
| 60ml Methanol 40ml RO degassed water 0.5ml Synthetic castor oil | Failed -Oil settlement | - | - | - | YES |
| 60ml Methanol 40ml RO degassed water 0.25ml Synthetic Castor oil | Passed | Passed -Slight Oil settlement | Failed -Oil settlement | - | YES |
| 60ml Methanol 40ml RO degassed water 0.05ml Synthetic Castor oil | Passed | Passed | Passed -Slight Oil settlement | Failed -Oil Settlement | YES Slight foaming |

Figure 15

SECONDARY FLUID FOR ENGINES

The present document claims priority to International application no. PCT/AU2022/050004 entitled A secondary fluid for engines, filed on 7 Jan. 2022, and Australian provisional patent application no. 202190021 entitled A secondary fluid for engines, filed on 7 Jan. 2021 the content of each of which are hereby incorporated by reference in their entirety.

TECHNICAL FIELD

The present invention relates to a secondary fluid for use in a dual fuel internal combustion engine. In an embodiment, the internal combustion engine is a diesel engine.

BACKGROUND

It is common for machinery to be powered by an internal combustion engine. One type of internal combustion engine is the diesel engine. In a diesel engine, the ignition of the fuel is caused by the elevated temperature of the air in the cylinder due to the mechanical compression. Another type of internal combustion engine is the petrol engine. A petrol engine does not work by only compressing the air. Instead, a petrol engine makes use of spark plug-ignition of the air-fuel mixture in the combustion chamber.

Some internal combustion engines are dual fuel engines. A dual fuel engine is adapted to combust at least two fuels. At least one of the fuels of the dual fuel is a primary fuel with a high specific energy (>30 mJ/L). The primary fuel can be diesel or gasoline (including petrol). The second of the fuels in the dual fuel engine might have a much lower specific energy since it complements the primary fuel. The secondary fuel can be referred to as a secondary fluid where the energy density of the material is so low that it could not otherwise be used efficiently as a primary fuel.

One of the limiting factors for improving the efficiency of the diesel engine is the increase in emissions that increased power outputs can cause (more fuel=more power (positive)= more emissions (negative)). When the diesel engine is run to increase power, it can become extremely hot and the engine typically becomes more polluting. The engine may release nitrogen oxides (NOx) into the atmosphere, which is environmentally damaging. Under current political circumstances, there is motivation to reduce emissions that contribute to global warming. More generally, there is a desire to keep air clean and safe for the people that breathe it.

In order to cool a diesel engine, a secondary fluid can be used to supplement the primary fuel by cooling the intake charge and reducing exhaust gas temperatures. One secondary fluid that could be used is a water/methanol blend. When a water/methanol blend is injected into the intake manifold of a diesel engine, it evaporates by exchanging energy with the charge mixture resulting in charge cooling.

One of the limiting factors for improving the efficiency of gasoline engines is engine knock. The fuel-air charge in a four-stroke engine is meant to be ignited by the spark plug only, and at a precise point in the piston's stroke. Knock occurs when the peak of the combustion process no longer occurs at the optimum moment for the four-stroke cycle. When a secondary fluid such as water or methanol is injected into the intake manifold, it evaporates by exchanging energy with the charge mixture resulting in charge cooling. This allows the engine to be run with advanced spark timing without engine knock. Exhaust gas temperatures decrease with the addition of water and water-methanol blends due to the combined effect of increased charge cooling and improved combustion phasing.

Cool air is denser than hot air and per unit volume has more oxygen than hot air. More oxygen per cylinder charge means a more efficient fuel burn and more power. However, despite the advantages of a secondary fluid, the engines that use them typically have problems.

A problem with the injection of water and methanol blends into any engine is that over time the secondary fluid can corrode the engine including the engine valves, valve seats, piston rings, cylinder bore and any other sensitive gaskets and hoses in the inlet track and fuel system. As a weak acid, methanol attacks the oxide coating that normally protects the aluminium in engine components from corrosion:

$$6CH_3OH+Al_2O_3 \rightarrow 2Al(OCH_3)_3+3H_2O$$

The salts that form are washed away with the methanol mixture leaving behind a surface ripe for reoxidation, and the process continues. Over time, the methanol blends can cause rusting and corrosion which ultimately damages the engine.

An anti-corrosion additive can be added to reduce the effect of the blend on the engine surfaces. Sometimes multiple additives are added to a fuel to provide various desired properties. Some lubricity enhancers or anti-corrosion additives comprise polar molecules that are attracted to the metal surfaces of the engine. The additives comprise molecules that assemble on the metal surface via polar constituents so as to provide a protective film. The additives can in some instances neutralize at least some of the corrosive acids in the fuel mixtures. However, additives can suffer from low levels of solubility, and saturation can occur resulting in the additives settling out of solution and becoming a problem themselves.

Accordingly, there exists a need for systems and liquid fuels and fluids that improve the efficiency of an internal combustion engine, but without providing deleterious side effects such as increased emissions, excessive engine fouling or engine damage. The present invention seeks to overcome or at least ameliorate at least some of the problems of the prior art, or at least to provide a useful alternative.

SUMMARY OF INVENTION

In a first aspect there is provided a secondary fluid for use in an internal combustion engine that burns a primary fuel, the secondary fluid comprising:

- about 15 vol % to about 30 vol % of alcohol;
- about 0.0025 vol % to about 0.5 vol % of a lubricity enhancer optionally comprising castor oil;
- with the remainder being made up of degassed water;
- wherein secondary fluid comprises a thermodynamically stable microemulsion with water being the continuous phase.

The weight percentage (wt %) of the degassed water can be in the range of from about 84.9975 vol % to about 65.5 vol %.

In an embodiment, the secondary fluid consists only of the ingredients listed. While the secondary fluid may consist essentially of only of the ingredients listed, it should be understood that inclusions of small amounts of materials that have no material effect on the working of the secondary fluid can be within scope.

Thus, the present invention provides a stable, storable fuel/secondary fluid that is combustible in an internal combustion engine but substantially non-flammable outside the engine, said fuel consisting essentially of a two-phased fluid of, about 84.9975 vol % to about 65 vol % of water, about 15 vol % to about 30 vol % of alcohol, about 0.0025 vol % to about 0.5 vol % of a lubricity enhancer comprising castor oil, the resulting emulsion comprising a standard oil/water emulsion with water being the continuous phase.

Without being bound by theory, it is thought that the secondary fluid comprises an emulsion of water, alcohol and castor oil. The emulsion is thought to be thermodynamically stable at least during injection into the internal combustion engine. By making use of the lubricity enhancer, in embodiments, the deleterious effects of the water/alcohol blend on the engine components can be at least reduced. The castor oil is an environmentally friendly, safe to handle lubricity enhancer that in embodiments does not result in any unwanted by-products emitted to the air as a part of the combustion process. Furthermore, the addition of this secondary fluid into the inlet air steam of the engine can mean that when the fluid is being injected it is washing, lubricating and or cleaning the inlet track. This wet intake can be advantageous where over time, carbon deposits can build up in the intake manifold and cylinder head. This is largely carbon left over from the combustion process mixed with oil vapour from the engine crankcase breather system. Over time these carbon deposits block the engine intake, cause high emissions and a decrease in power.

The inventor has found that the addition of castor oil in the range specified can result in a surprisingly stable secondary fluid emulsion that has a number of advantages for engine performance. In embodiments, the secondary fluid of the present invention can assist in lubricating the engine which is important for the longevity of the engine as components move relative to one another. In embodiments, the secondary fluid of the present invention can assist in cooling the engine which can result in improved performance and emission reduction (particularly NOx). In embodiments, the secondary fluid of the present invention can provide the engine with more power but with less deleterious downsides such as soot formation, which can result in improved performance and emission reduction. There can in embodiments also be efficiency gains meaning that the power output to fuel input can be increased. In embodiments, the secondary fluid of the present invention can be anti-corrosive increasing the longevity of the engine parts notwithstanding the use of alcohol and water.

Castor oil mixed with methanol has been used to lubricate conventional two cycle engines (and four strokes). However, this is the first instance where castor oil has been successfully integrated into a substantially aqueous secondary fluid. Thus, there is provided a substantially aqueous fuel supplement for use with a primary fuel, wherein the substantially aqueous fuel supplement comprises a thermodynamically stable emulsion of water and methanol and castor oil.

A stable emulsion is one where de-emulsification within a specified time-frame at room temperature and pressure does not happen without some intervention such as the additional of new components or the input of energy. Accurate results on de-emulsification can be determined by conductance or optical measurements, but a visual inspection can also show whether components remain emulsified. An emulsion is typically an opaque or substantially opaque mixture that appears to be a single phase rather than two separate and distinct phases. The emulsion is, of course, at least two phases, but one phase is dispersed in the other and gives the appearance of one solution. As de-emulsification occurs, one phase begins to settle relative to the other phase until the first phase is floating on the second phase (or vice versa). Emulsion stability can be measured in standing time. The standing time is the time measured from when the emulsion was first prepared (time 0) to the amount of time the emulsion stands i.e., is left to stand and allowed to separate to two phases naturally. Standing time can be measures in seconds, minutes, days, weeks, months, and years. The present emulsion can be stable until energy is added to destabilise. The present emulsion can be stable for at least 6, 8, 10, 15, 20, 35, or 50 weeks. The present emulsion can be stable for at least 6, 12 or 18 months. It should be understood that there may be some small percentage of de-emulsification or settlement of components (e.g., 0.5, 1, 2 or 3%) over the time periods measured, but this is not enough to result in the emulsion being considered as unstable. In an embodiment, the emulsion is stable for 6 months with about 3% de-emulsification.

The present emulsion is said to be thermodynamically stable. Most emulsions are kinetically stable (thermodynamically unstable) which means that they are stable for a period of time, but separate into the component parts over time. A thermodynamically stable emulsion does not separate into the component parts over time. Evidence for the present emulsion being thermodynamically stable is that the emulsion forms spontaneously and does not require the input of energy to emulsify.

A preferred method of forming the emulsion comprises mixing together the alcohol and the lubricity enhancer such as castor oil before introducing the water phase. The resultant alcohol/castor oil blend can be then added to the water to form the emulsion.

In a second aspect, there is provided a method for forming a secondary fluid for use in an internal combustion engine, the method comprising

- mixing castor oil with an alcohol to form an alcohol/castor oil blend,
- combining the alcohol/castor oil blend with degassed water to form an emulsion.

The resultant emulsion of secondary fluid can comprise or consist essentially of about 15 vol % to about 30 vol % of alcohol; about 0.0025 vol % to about 5 vol % of castor oil; and about 84.9975 vol % to about 65 vol % of degassed water. While the secondary fluid may consist only of the ingredients listed, it should be understood that inclusions of small amounts of materials that have no material effect on the working of the secondary fluid can be within scope. For example, there may be impurities introduced with the water that are measurable but that make no contribution to the working of the invention.

It should be understood that the description as it relates to the first aspect of the invention applies equally to the description of the second aspect and vice versa, unless the context makes clear otherwise.

The method according to the second aspect of the invention for forming the secondary fluid results in an embodiment of the secondary fluid according to the first aspect. Notwithstanding this, the secondary fluid according to the first aspect of the invention is not limited to being formed by the method of the second aspect and there may be other methods that can be employed to result in the secondary fluid.

Emulsions are typically made by adding a water phase and an oil phase together with a surfactant to form a mixture. Shear energy can be applied to the mixture by impeller to create droplets which are stabilised with the surfactant. The shear energy breaks the oil phase up into droplets and without the surfactant, when the impeller is turned off the two phases would separate again.

In the present invention, in embodiments, the two phases water and alcohol can be mixed together with minimum energy input. By minimum energy input it is meant that the step of mixing the castor oil with alcohol to form an alcohol/castor oil blend can be done without heating and or without high-energy stirring. In an embodiment, however, at least one or both of the method steps is undertaken with the input of heat and or high-energy stirring.

The step of mixing the castor oil with an alcohol to form an alcohol/castor oil blend can comprise adding the castor oil to the alcohol. The castor oil can be added to the alcohol in any way including dropping, spraying, pouring, injecting. Alternatively, the alcohol can be added to the castor oil. The alcohol can be added to the castor oil in any way including dropping, spraying, pouring, injecting.

The step of combining the alcohol/castor oil blend with degassed water can comprise adding the alcohol/castor oil blend to the water. The alcohol/castor oil blend can be added to the water in any way including dropping, spraying, pouring, injecting. The step of combining the alcohol/castor oil blend with degassed water can comprise adding the water to the alcohol/castor oil blend. The water can be added to the alcohol/castor oil blend in any way including dropping, spraying, pouring, injecting.

The step of combining the alcohol/castor oil blend with degassed water results in an emulsion. The emulsion can be a macro emulsion. The emulsion can be a microemulsion. The emulsion can be an inverse emulsion. The emulsion can be a multi-phase emulsion. In a preferred embodiment, the emulsion is a thermodynamically stable microemulsion.

The ingredients are mixed into a single phase of alcohol/water/castor oil. Water and methanol are miscible and water and castor oil are miscible. As the ingredients mix, a cloud point is reached as the castor oil rich phase separates from the water rich phase due to the overall change in free energy. It is thought that the alcohol is spread out across both phases. When a new phase is created like this it starts at the molecular level and then coalescence occurs until droplets of the dispersed phase begin to form. Without being bound by theory, it is thought that at least some components of the castor oil are acting as non-ionic surfactant. The non-ionic surfactant can stabilise the dispersed oil phase that it forms (in essence it has the capacity to stabilise a fixed surface area of droplets subject to the amount of castor oil in the mix). When this fixed surface area is reached the coalescence stops and the stable emulsion is the result. Forming the emulsion in this way may result in a microemulsion. In an embodiment, the secondary fluid is a stable microemulsion of water, alcohol and castor oil.

To achieve this liquid system of the present invention, the method for manufacture and ratios of ingredients can be important. Simply tipping water, methanol and castor oil into a vessel will not result in a stable emulsion. The present inventor has found that under controlled circumstances, the optimum result can be achieved. In a first step, each of the ingredients must be prepared for use. The preparation can include degassing the water as described in more detail below. The ingredients are then combines as described.

Another option for forming the emulsion comprises

1. Provide degassed water. The water can be provided in a shear tank. The degassed water can be stirred the degassed water vigorously (typically up to 1000 rpm). Optionally, the water can be kept a constant temperature in a heated water bath. The temperature can be at least about 26, 28, 20 or 35 degrees. A temperature slightly above room temperature will increase the energy in the system and should assist in the formation of the emulsion. If the temperature is too high, there is a danger that chemicals will start to degrade or unexpectedly react with one another to provide unusual by-products.
2. Add the castor oil. The castor oil can be added into the centre of the impeller. An emulsion should form upon addition of the oil into the water.
3. Add the methanol. The methanol should become integrated into the emulsion.

The formulation can comprise about 0.0025 volt % to about 1 vol % of a lubricity enhancer, preferably 0.03 vol % to about 0.5 vol %, preferably 0.3 vol % to about 0.5 vol %, preferably 0.02 vol % to about 0.05 vol %. The formulation can comprise at least about 0.0025 wt %, 0.03, 0.3, 0.5, 0.8, 1 vol % of the lubricity enhancer. The formulation can comprise at most about 0.0025 wt %, 0.03, 0.3, 0.5, 0.8, 1 vol % of the lubricity enhancer. It is preferred that there is not more than 1 vol % of the lubricity enhancer. It is thought that too much lubricity enhancer in the formulation can decrease the stability of the resultant emulsion. The amount of lubricity enhancer required to form a thermodynamically stable emulsion may change according to amount of water and alcohol in the formulation.

The lubricity enhancer is described herein as a castor oil, but this is exemplary only. The lubricity enhancer can be any triglyceride. The triglyceride can be a vegetable oil. The vegetable oil can be derived from castor beans. The vegetable oil derived from castor beans can be, in a preferred embodiment, castor oil. Castor oil is an environment-friendly bio-based product, which is non-toxic, harmless, and biodegradable. The castor oil is preferably used without modification prior to injection, but the processes in the engine will likely have some effect on the castor oil chemistry. The castor oil triglyceride comprises about 90% of fatty acid chains that are ricinolates. Oleate and linoleates are the other significant components of castor oil. The castor oil used in embodiments of the invention can be prepared naturally. The castor oil used in embodiments of the invention can be prepared synthetically. Where the castor oil is made synthetically, the percentage range of the components of the oil can be varied from the natural range of the various components provided the same lubricity enhancement effect is observed.

The castor oil can comprise mostly ricinolates. Ricinoleic acid is unusual in that it has a hydroxyl functional group on the 12th carbon. This functional group causes ricinoleic acid (and castor oil) to be more polar than most fats. Accordingly, in an embodiment, the lubricity enhancer is a polar triglyceride which behaves similarly to castor oil.

In an embodiment, the castor oil comprises ricinoleic acid in a range of from about 85 to about 95%, oleic acids in a range of from about 2 to about 6%, linoleic acid in a range of from about 1 to about 5%, α-Linolenic acid in a range of from about 0.5 to about 1%, stearic acid in a range of from about 0.5% to about 1%, palmitic acid in a range of from about 0.5% to about 1%, dihydroxystearic acid in a range of from about 0.3% to about 0.5%. The balance of about 0.2% to about 0.5% can comprise other short and long chain compounds. The castor oil can be a natural castor oil extracted from the castor bean. Alternatively, the castor oil can be a synthetic castor oil. Where the castor oil is synthetic, the ricinoleic acid may be present with other short and long chain compounds that are different to those in the natural oil.

Preferably, the lubricity enhancer is silicone free. It is expected that any silicone-based product would be detrimental to modern exhaust sensors and possibly cause issues with catalytic converters and particulate filters. Furthermore, the lubricity enhancer is substantially free of chemicals that do not combust at usual cylinder operating temperatures. If there are chemicals in the additive that combust at low temperatures (lower than combustion temperature), these can damage an engine. If there were to be chemicals that combust at high temperatures (outside of the combustion range) these may block exhaust treatment systems with non-combusted material.

This secondary fluid product is pumped into the internal combustion engine under pressure (200-300 psi). It is thought that any surfactant that is known to cause pumping difficulties could cause aeration/foaming. Thus, the fluid is preferably free from any foaming surfactant or any surfactant that would present pumping difficulties in use.

In some embodiments, the secondary fluid further comprises a surfactant. In this embodiment, the surfactant could be added to stabilise the water and oil mixture to which the methanol could be added. Preferably, the surfactant is non-foaming. If a foaming surfactant is used, then a defoaming agent could be added.

The alcohol component can be any alcohol that is miscible with water. The alcohol can be 90, 95 or 100% miscible with water. The alcohol can be selected from one or more of methanol, isopropanol, propanol, 2-butanol, n-butanol and ethanol. In a preferred embodiment the alcohol is methanol.

The specific gravity of the water is 1 at 25 degrees C. The specific gravity of methanol is 0.7866 at 25 degrees C. The specific gravity of castor oil is 0.959 at 25 degrees C.

The formulation can comprise about 15 vol % to about 30 vol % of alcohol, preferably 20 to 25 vol %, more preferably 24 vol %. It is preferred that there is not more than about 30, 40 or 50 vol % alcohol. It has been found that if the alcohol is at 50:50 with the water, the castor oil in the mixture tends to settle to the bottom over a few days. It has also been found that when the alcohol is at lower percentages, e.g., 10 vol %, the castor oil tends to settle to the surface over a few days. At higher levels of alcohol, e.g. 30 vol % it may be advantageous to use a synthetic castor oil with improved surfactant properties.

The components are preferably added in amounts such that the specific gravity of the methanol/water blend (X) is about the same as the castor oil (0.959) at ambient temperature and pressure. It has been found that about 25-30% of methanol to about 65-70% water provides this advantage of a SG of about 0.9. It is thought that by matching the specific gravities, the stability of the emulsion can be increased (increased standing time) compared with emulsions in which the specific gravities are not substantially matched. The amount of castor oil in the formulation can be adjusted to match the specific gravity. In an embodiment, one particular matched SG formulation comprises: about 75 vol % to about 85 vol % water; about 18 vol % to about 25 vol % of alcohol; and about 0.04 vol % of a lubricity enhancer optionally comprising castor oil.

The water can be from any source. The water can contain some impurities, however, preferably the water is substantially pure to reduce the likelihood that there are impurities in the water that would be detrimental to modern exhaust sensors and possibly cause issues with catalytic converters and particulate filters. The water can be deionised water. The water can be deionised by an anion exchange purifier. The water can also be purified by the use of reverse osmosis to remove salts and any low molecular weight impurities. Any other commonly known water purification technique can be used.

The water can be degassed water. The water can be degassed by any means that removes at least about 80, 90, 95, 99 or 100% of the dissolved gas, usually air. The removal of the gas is thought to increase the resultant stability of the emulsion that forms. Water used in the present invention can have some gas therein, however it is thought that degassed water increases the stability of the emulsion. The stability of the emulsion using degassed water probably lies in the removal of the self-organization of dissolved gas bubbles and the reduction in the cooperativity in gas molecular interactions that likely assist in de-emulsification. In some embodiments, the alcohol can also be degassed, although this is unlikely to be necessary since studies have shown a minimum amount of dissolved gases in alcohol even at elevated temperatures.

In the present dual fuel system, the primary fuel has a high specific energy (>30 mJ/L). The primary fuel can be diesel or petrol. The second of the fuels in the dual fuel engine might have a much lower specific energy since it complements the primary fuel. The secondary fuel can be referred to as a secondary fluid where the energy density of the material is so low that it could not otherwise be used efficiently as a primary fuel. Methanol has a low energy content of about 19.7 MJ/kg. When methanol is used as the alcohol, the formulation is referred to as a secondary fluid because at that energy content the amount of methanol required to power an engine would be prohibitively high.

During a cylinder combustion cycle, only the primary fuel can be injected into the engine cylinder. Where a secondary fluid is used, at some points in the combustion cycle only the secondary fluid can be injected into the engine cylinder. Alternatively, both primary fuel and secondary fluid may be injected into an engine cylinder. The injection of one or both of the primary fuel and secondary fluid may occur by one or more fuel injectors of the engine cylinder.

The secondary fluid can be housed in a secondary fluid tank separate from the primary fuel tank. The secondary fluid tank can be integrated with the vehicle such that its contents can be dispensed to the intake as necessary. There can be a sensor in the tank to indicate when the tank requires the addition of more fluid. In embodiments, the secondary fluid is provided to the tank as an emulsion. However, it is possible that the secondary fluid could be provided to the tank in separated compartments. In a first compartment, the water could be stored. In a second compartment, the e.g. alcohol/castor oil could be provided. In embodiments there are three compartments one for each liquid. Just prior to injection of the secondary fluid, the water could be mixed with the alcohol and castor oil to provide the emulsion. This could happen but realistically it is not preferred due to the complexity in the process and because the emulsion as described is stable enough not to require preparation just prior to use. In embodiments, the water used to form the emulsion can be collected and filtered from any one of the following areas: the exhaust system of the vehicle; incoming engine air; the vehicle air conditioning evaporator drains. It is thought that this will reduce tank fill up requirements, reduce needed tank size and extend the duration between top ups.

In embodiments, where the system makes use of injection into the manifold, the secondary fluid system can be retro fit to the engine. A conversion kit comprising the required component can be provided for retro-fit to the engine.

The amount and timing of the secondary fluid introduced to the intake can be controlled by the Engine Management System (EMS). The EMS can take readings from a plurality of sensors and then controls a series of actuators to ensure optimal engine performance. An oxygen sensor can inform whether the engine is running rich (too much fuel or too little oxygen) or running lean (too much oxygen or too little fuel). A throttle position sensor can inform how far the throttle plate is opened when the accelerator is activated. A mass air flow sensor can measure the amount of air flowing into the engine through the throttle plate. An engine coolant temperature sensor can inform whether the engine is warmed up or cool.

When required, the secondary fluid can be introduced as a fine mist. The secondary fluid can be introduced via a jet using known injection components.

According to one aspect of the invention there is provided a method of operating or causing to be operated a dual fuel internal combustion engine comprising the steps of

- introducing a primary fuel to a combustion chamber of the internal combustion engine at a first time,
- introducing a secondary fluid as described herein to the combustion chamber of the internal combustion engine at a second time, wherein the second time is at a different time to the first time,
- wherein the introduction of the secondary fluid is controlled by an Engine Management System, operably connected to engine sensors, to optimise engine performance.

In some diesel engines there is a Diesel Particulate Filter (DPF) adapted to catch the remaining particulates left within the combustion cycle of the diesel engine. Each combustion cycle includes un-burnt components of diesel fuel, carbon and particulates that accumulate into a visible smoke from the exhaust stacks. As an exhaust component, continually clogging from the perpetual operation of a diesel engine, this filter is built into a system where it essentially cleans itself of the build-up. A regeneration cycle can be initiated by the EMS when it detects that the filter requires cleaning. The regeneration cycle comprises increasing the temperature of the filter to pyrolyze the unburnt components forming the build-up. In an embodiment, the introduction of secondary fuel (at the second time) does not occur during the regeneration cycle for the engine. The secondary fuel is intended to reduce the temperature of the exhaust gases, so providing this advantage during a regeneration cycle would be counter to the intended effect.

The use of the present secondary fluid cools the intake air charge. Water vaporising is thought to contribute mainly to this effect along with some benefit from the alcohol vaporising. This cooling of the intake air charge reduces the likelihood of pre-ignition or engine knock. The present mixture can, under certain circumstance, and in certain injection quantities, be computer controlled to adjust the time between a diesel injection event and the start of combustion. Adding a lag time between the two events happening in the engine cycle. Adding additional fuels to a diesel engine such as hydrogen may increase the likelihood of engine knock or a backfire in the engine intake manifold. Hydrogen has a very fast flame speed. However, by using the present secondary fluid it may be possible to safely co-inject hydrogen on a non-modified, standard diesel engine (retrofitted). Hydrogen is also a very small molecule, and it is thought that the addition of the lubricity enhancer in the present fluid may help with engine piston ring sealing and valve sealing, further reducing the likelihood of backfire or a build-up of hydrogen gas in the engine crank case. Furthermore, hot carbon particles left over in the engine combustion chamber, intake path or exhaust may also cause hydrogen gas to combust unexpectedly. It is thought that the present secondary fluid may help to remove carbon deposits and prevent them from forming (steam cleaning). Thus, in embodiments, the present secondary fluid is used together with an additional fuel in addition to the primary fuel. The additional fuel can be hydrogen.

In some circumstances, it may be beneficial to inject additional alcohol or gasoline for an even greater total calorific value of fuel. Co-injection may achieve the benefits of cooling, and add extra alcohol or gasoline for cleaner engine energy production.

In some instances, in the background art, methanol and water have been mixed directly into the fuel such as diesel being, so as to be injected as one fuel. This is different from the intended use of the secondary fluid of the present invention, which is intended to be added through the intake at a different time to the primary fuel. A downside of introducing the secondary fluid together with the primary fluid is that, at least for a diesel engine, the mechanical side of the diesel injection system would not tolerate the combined injection for very long. A secondary injection system that communicates with the primary fuel system computer would ultimately be a more reliable approach although it would require a secondary fuel tank and some other standalone components.

The secondary fluid of the present invention may boost performance by about 30, 50 or 80%. In some embodiment, subject to the size of the engine, this can be an increase in performance of about 80, 90, 100 or 120 hp (60, 65, 75 or 90 kW).

The term internal combustion engine as used herein is intended to refer to and encompass any engine in which carbonaceous fuel is combusted with oxygen in one or more combustion chambers of the engine. Presently known such engines include piston displacement engines, rotary engines and turbine (jet) engines, including electric spark ignited and compression, e.g., diesel engines. In embodiments, the engine can be any compression ignition engine.

The engine can be for transport, or it can be for power generation used in a stationary role (generator). In embodiments, the secondary fluid is used in an engine on a ship. Since a substantial quantity of the secondary fluid is water, a ship would not need to carry as large a tank of water and instead could source it from the surrounds. The water could be brought on board, while in motion, and desalinised.

BRIEF DESCRIPTION OF THE FIGURES

Embodiments of the invention will now be described with reference to the accompanying drawings which are not drawn to scale and which are exemplary only and in which:

FIG. 1 is a table showing the results from 50% Load dynamometer testing.

FIG. 2 is a table showing the results from 75% Load dynamometer testing.

FIG. 3 is a table showing the results from on road testing—5 min Average testing.

FIG. 4 is a table showing the results from on road testing—10 min Average testing.

FIG. 5 is a table showing Light Load testing—Low Speed.

FIG. 6 is a table showing Light Load testing—Medium Speed.

FIG. 7 is a table showing Engine data recorded at 50% load.

FIG. 8 is a table showing Engine data recorded at 75% load.

FIG. 9 is a table showing performance measures of an engine using an embodiment of the secondary fluid of the invention.

FIGS. 10 to 15 are tables showing the results from emulsion stability testing.

DETAILED DESCRIPTION OF EMBODIMENTS OF THE INVENTION

About 240 mL of methanol was combined with 1 ml of castor oil. The mixture was stirred until the castor oil was dispersed throughout the methanol liquid. Water was degassed at 28 inches of Hg for 1 hour. The degassed water was added to the methanol/castor oil blend to make up to 1 litre (about 759 mL of water). The resultant emulsion was allowed to stand overnight. The emulsion was cloudy and opaque white in colour. After 6 months, there was no evidence of separation of the emulsion.

The secondary fluid emulsion prepared according to the experiment above was added to a tank connected with a diesel engine. About 200 mL was added to the tank slowly by pouring. The engine was started and diesel fuel was corn busted to power the engine. Intermittently, the secondary fluid was pulled into the air intake under the influence of the engine management system. When the secondary fluid was to be injected, the fluid was pulled from the tank via a hose and injected by a nozzle just prior to the combustion chamber.

The water in this secondary fuel is thought to be useful for cooling. The water is thought to lower intake air charge temperature and provides significant cooling and in some cases significant delay of the initial combustion process. Water may also help to prevent the deleterious effect of premature ignition of the alcohol fuel in relation to the engine cycle. Water injection on its own is known to lower NOX production in diesel engines, while also reducing exhaust gas temperature. Water vapour when added at the correct ratio essentially crowds out space for air in the engine cylinder. Somewhat lowering the chance for oxygen and nitrogen in the cylinder creating NOx emissions during combustion.

The alcohol in the emulsion is thought to be useful for further reducing NOx production by changing the fuel reactivity when combusted along with diesel fuel in the cylinder of the engine. Diesel fuel is quite "reactive" and as such tends to generate considerable NOx and N2O emissions. Having a homogeneous in cylinder mixture of low reactivity fuel (Alcohol) in testing has shown to dramatically lower NOx and N2O production. The Alcohol is also thought to allow for the spontaneous emulsion of the lubricity enhancer (which can be castor oil), whether it be natural or synthetic.

The castor oil in this emulsion is thought to be useful for engine lubrication and rust prevention of components in the inlet air path of the engine and combustion chamber, that would ordinarily be brought about by water or alcohol. Large amounts of the lubricity enhancer are thought to be not advantageous. In fact the opposite, particularly for emissions may be true. The smallest amount and droplet size of castor oil that satisfies the corrosion test while retaining lubricity is the aim in the formulation.

This secondary fluid according to an embodiment can be used for several reasons:

1) Lubricate, protect and clean the inlet/intake manifold, cylinder head, combustion chamber, cylinder bore and piston/s. (Typically, at 75,000 kms or sooner a modern diesel will have intake blockage occurring).
2) Cool an engine and reduce exhaust gas temperature (NOx emissions reduce with lower combustion temperature).
3) Add engine power by various percentages depending on quantity injected—the engine power could increase by about 2, 5 or 8% as a minimum increase. However, higher powers could be achieved.
4) Help extend the life of the diesel particulate filter (DPF) and various exhaust components by lowering soot emission and reducing DPF regeneration frequency.
5) Act as a partial fuel that is a much "cleaner" alternative to diesel.

In use, the secondary fluid can be pumped under pressure and timed for precise injection when the engine is under high load (that is, burning lots of fuel and creating lots of heat). The increase in heat unfortunately increases NOx emissions. At a certain pre-determined elevated exhaust or cylinder temperature the secondary fluid could be injected into the inlet manifold of the engine. The injection can be any type of injection including direct injection or fumigation. In embodiments, the diesel fuel quantity could be reduced and the secondary fluid (carrying its own energy from the methanol) could be injected to match the reduced energy content from the subtracted diesel. Theoretically the engine would receive the same total amount of energy, create very similar power; however, receive the cooling and lubricating effects of the secondary fluid, while burning a certain percentage of cleaner fuel (methanol) and lowering overall emissions.

The benefits of manifold injection (after the air filter) may allow for cleaning carbon, etc, from the manifold that is left over from the combustion process of diesel fuel and mixed with engine oil vapour that is drawn back into the intake manifold and engine via the exhaust gas recirculation valve and crank case breather system. When wet intake manifold injection is utilised (could be a single injector, one for each cylinder or more in any location in the intake manifold) this allows the present fluid to come into contact with recent deposits of carbon and engine oil etc. These deposits can in principle be simply washed away by the liquid, ingested by the engine and expelled through the exhaust. Conversely when using a dry-type intake manifold with direct cylinder injection (could be a diesel or gasoline engine) there is no washing and the carbon and oil etc builds up over time eventually blocking the intake manifold, EGR and cylinder head (Ports and valves)

It is thought that if the secondary fluid according to various embodiments is allowed to enter via the engine inlet valve/s naturally it will lubricate, cool and clean the inlet valve/s. This may also allow an easy installation/retrofit on engines that are already built and out there being used now.

During induction—around 180 degrees of crankshaft rotation—(one complete stroke of a four-stroke engine cycle) it is thought that the secondary fluid will be in contact will an extremely hot cylinder walls and pistons. Following this, another 180 degrees, the compression stroke will occur and further polymerization in the secondary fluid will potentially happen as the temperature begins to increase. After this comes combustion/power stroke which will elevate temperature and pressure considerably, and the lubricity enhancer of the secondary fluid is thought to further polymerize and/or combust. After that, a further 180 degrees on the exhaust stroke (where it is suspected (but not yet known)) that there is little lubrication that takes place here although some) the secondary fluid will eventually be expelled, and the procedure starts again.

Example 1—Emulsion Stability Comparison with Varying Alcohol and Synthetic Castor Oil Content Water has a high heat of vaporisation and is therefore an excellent candidate for engine heat management when incorporated in a secondary fuel emulsion. Water contains dissolved gasses such as O2, N2 and CO2. Some of which lead to rust and corrosion of various metals that are found in diesel engines, engine induction systems or injection equipment. Water on its own has a poor ability to lubricate. An ideal, predominantly aqueous secondary fuel should be a stable emulsion that contains low amounts of dissolved gases, an ability to reduce rust and corrosion and have a lubricity factor. It should have a high ability to cool the engine intake charge and add an alternate clean fuel source, such as short chain alcohols. The secondary fuel should not significantly negatively affect exhaust emissions or damaging delicate exhaust sensors or control equipment.

Secondary fuels, during shipping, or when used in vehicles will be subject to vibration or periods of long standing. It is important the present emulsion does not allow oil to settle, have significant amounts present on the surface or create foaming. This will ensure effective use within engine injection systems or in high pressure pumps.

Various embodiments of secondary fuel emulsions were visually examined for stability and foaming properties with varying ethanol, methanol and castor oil quantities.

Materials and Methods

Without wishing to be limited by theory, it is thought that a water, alcohol and castor oil emulsion will be stable for long periods when the specific gravity of castor oil is about equal to the specific gravity of the combined water and alcohol components. Consideration was given to other gases phases in the reverse osmosis water.

Degassed reverse osmosis water was mixed with ethanol and methanol in varying volumes:

Ethanol Experiments

RO degassed water by volume: 95 mls, 81 ml and 40 ml

Ethanol by volume: 5 ml, 19 ml and 60 ml

The ethanol was mixed with various amounts of synthetic castor oil with a stirrer at 300 RPM for 10 seconds. Synthetic castor oil quantities were varied, and the results examined in the following volumes: 1 ml, 0.5 ml, 0.25 ml and 0.05 ml.

A bittering agent was added to some samples.

Methanol Experiments

RO degassed water by volume: 95 mls, 77 ml and 40 ml

Methanol by volume: 5 ml, 23 ml and 60 ml

The methanol was mixed with various amounts of synthetic castor oil with a stirrer at 300 RPM for 10 seconds. The vol % of castor oil is measured as a volume per 100 ml of injected secondary fluid. Synthetic castor oil quantities were varied, and the results examined in the following volumes 1 ml (1 vol %), 0.5 ml (0.5 vol %), 0.25 ml (0.25 vol %) and 0.05 ml (0.05 vol %).

The samples were each sealed and allowed to stand for varying time periods or until the emulsion failed. The emulsions were each vigorously shaken to detect any foaming. Visual inspections for separation were undertaken after time periods: 1 hr, 12 hr, 1 week and 1 month. Results can be found in the Tables of FIG. 10 to FIG. 15.

In embodiments in which water and alcohol was combined to have a specific gravity similar to castor oil (ethanol 19 ml and methanol 23 ml) performed well with low quantities of synthetic castor oil. It is noteworthy that the SG of the water alcohol mixture in the experimental emulsions is slightly lower than that of castor oil. This is to allow for any alcohol evaporation during use, and to slightly increases the Calorific Value of the secondary fluid with negligible negative effects on the resulting emulsions. Low quantities of castor oil are desirable for engine emissions and have been shown to satisfy the corrosion test while retaining a lubricating film.

As can be seen from the Tables of FIGS. 10 to 15, methanol slightly outperformed ethanol for emulsion stability. It is thought that this is because methanol is a shorter chain alcohol which has a better miscibility with water.

It is thought that the removal of gases from the RO water in these experiments creates a more stable emulsion by increasing the energy required for oil particles to come together. Further, there may be a slight mechanical effect bringing oil particles to the surface as some of these gasses rise from the emulsion. It is thought that once a successful spontaneous emulsion is made with degassed water there is a reduced likelihood of dissolved gases re-entering the emulsion. Further research should be conducted around the role of amphoteric alcohols in spontaneous oil/water emulsion formation.

Example 2—Rust Evaluation of Mild Steel, Comparing Reverse Osmosis Filtered Water with an Embodiment of the Present Secondary Fluid Engine intake water injection is a successful way to reduce NOx emissions and enhance brake power output. The advantages of water injection are due to its high enthalpy of vaporization and high specific heat capacity by which it absorbs heat from the in-cylinder mixture. Disadvantages of water injection include that water contains dissolved oxygen and therefore creates corrosion and rust.

A metal test piece has been found to have various corrosion effects at ambient temperature. Even the oxygen in the air causes rust and corrosion over time, and this is made particularly worse when the metal in an engine is washed with water (and optionally methanol) and then left to sit with the liquids covering these metal components. Water, when injected into an engine induction system and ultimately the engine combustion chamber will likely come into contact with mild steel and other metals. It is also likely small areas of pooling, particularly in the engine intake manifold will occur, creating corrosion or rust. These corrosion and rust particles over time will travel through the engine creating abrasion and engine wear. Further, should a non-atomized droplet of water come into contact with high temperature engine components the lubricating oil film will be negatively affected and accelerated engine wear is likely to occur.

It is therefore advantageous for the injection liquid to contain a resistance to corrosion/rust and a lubricity factor, while not significantly contributing to negative combustion emissions, or having the ability to damage exhaust system sensors or equipment. Castor oil has an affinity for metal and is thought to act not only as a lubricant, but also a corrosion inhibitor. This is particularly valuable during initial or dry start i.e. before crankcase oil has been splashed or pumped to the cylinder bore and underside of the piston.

A comparison of rust within a specific time frame was conducted between reverse osmosis filtered water (control) and the present secondary injection fluid on mild steel.

Droplets of the reverse osmosis filtered water (control) and the present secondary injection fluid were applied to the mild steel and allowed to sit for 24 hours. The experiment was repeated 3 times over 3 consecutive days under ambient conditions.

Materials and Methods reverse osmosis water.

secondary injection fluid comprising:

80.96% Volume Reverse osmosis filtered and degassed water.

19.00% Volume Ethanol 0.04% Volume Synthetic Castor oil

A mild steel plate was prepared for rust analysis by surface sanding and preparation with isopropyl alcohol. Ambient weather conditions were recorded during the time of evaluation and recorded as temperature 14 to 16.2 degrees centigrade and 36 to 56% humidity.

Results

Significant rusting of mild steel was evident within the 3-day time period when testing with reverse osmosis water.

No rusting was evident with the present secondary injection fluid on mild steel. A protective and lubricating film appears to be evident, after water and alcohol evaporation.

Example 3—Engine Operating Conditions Measured During Dynamometer 50% and 75% Load Testing Engine operating conditions were examined comparing a standard diesel engine and the same engine fitted with a secondary fluid injection system for injecting two embodiments of secondary fluid labelled as CC-E and CC-M.

Materials and Method

A Standard WL-T 2.5 L Turbo Diesel Mazda engine was equipped with a data logging device to record various engine operating parameters. The vehicle was fitted with a computer-controlled injection system, which adjusts injection quantity based on engine air mass flow. A single injection nozzle was used to fumigate the engine intake manifold Standard Shell® brand Diesel fuel was used.

secondary injection fluid CC-M comprising by volume:

76.96% RO and degassed Water

23% Methanol 0.04% Synthetic Castor oil secondary injection fluid CC-E comprising by volume:

80.96% RO and degassed Water

19% Ethanol 0.04% Synthetic Castor oil

The vehicle was tested on a Mainline chassis dynamometer. Maximum torque was first measured at 2,900 RPM and the dynamometer rollers were set such that the RPM could not be exceeded. The engine power was brought up to produce 50% and then 75% of the maximum measured torque at 2900 RPM. The throttle position required to produce 50% and 75% maximum torque was maintained and measured.

The following was measured:

Intake manifold air temperature.

Exhaust manifold gas temperature.

Engine intake air mass in grams of air per second.

Engine conditions were allowed sufficient time to stabilise before data was recorded. Peak engine KW power and NM torque were recorded and compared using a secondary fluid injection system ranging from 0 ml/minute to 150 ml/minute calculated based on engine air mass flow.

50% Load Dynamometer Testing

Secondary fluid CC-E and secondary fluid CC-M injection flow rate=75 ml per minute during all 50% load tests.

Results are shown in FIG. 7.

75% Load Dynamometer Testing

Secondary fluid CC-E and secondary fluid CC-M injection flow rate=150 ml per minute during all 75% load tests.

Results are shown in FIG. 8. The performance measured is shown in FIG. 9.

As can be seen from the Tables in FIGS. 7 to 9, air mass remained relatively constant, with the exception of with CC-E at 75% load. It is thought that this is because of water vapor taking up space in the engine intake path. Intake manifold temperature decreased significantly with both CC-M and CC-E. It is thought the larger water content in CC-E contributed more to cooling the intake charge. Exhaust gas temperature decreased significantly with CC-E and CC-M. It is noteworthy that the exhaust gas temperature decreased in a comparable rate to the intake air charge temperature. The larger content of water in CC-E appeared to offset the exhaust gas temperature even though it contains a higher overall calorific value.

Throttle position decreased, therefore diesel fuel required to make the same required torque was reduced. It is noteworthy that using CC-E the Diesel throttle position at 50% load was 4.7% lower.

Engine performance with CC-M and CC-E were both increased. It is seen that CC-M has a larger performance benefit. It is thought that CC-M has more favourable combustion characteristics in respect of KW and NM production when compared to CC-E.

Example 4—Exhaust Emission Testing Comparing a Standard Diesel Engine, with Two Embodiments of the Secondary Injection Fluid Diesel engines typically generate relatively high NOx exhaust emissions, particularly under moderate to high engine load. $N_2O$ emission production generally increases with engine load and are considered 300 times worse for global warming than $CO_2$ emissions.

Exhaust gas emissions testing will be conducted comparing a standard diesel engine and the same engine fitted with an injection system injecting an embodiment of the secondary fluid of the present invention. It is thought that intake manifold fumigation style injection of the present secondary fluid Water/Alcohol/Castor oil emulsion will improve exhaust emissions, by lowering combustion temperature, creating a more homogeneous cylinder mixture and altering total fuel reactivity.

Materials and Method

A Standard WL-T 2.5 L Turbo Diesel Mazda engine was equipped with a data logging device to record various engine operating parameters. The vehicle was fitted with a computer-controlled injection system, which adjusts injection quantity based on engine air mass flow. A single injection nozzle was used to fumigate the engine intake manifold Standard Shell® brand Diesel fuel was used.

secondary injection fluid CC-M comprising by volume:

76.96% RO and degassed Water

23% Methanol 0.04% Synthetic Castor oil secondary injection fluid CC-E comprising by volume:

80.96% RO and degassed Water

19% Ethanol 0.04% Synthetic Castor oil

Standard testing was undertaken without secondary fluid. A control comprising 100% RO water injection as a secondary fluid was also tested on road.

The secondary fluid injection quantity was recorded for all dynamometer testing. Light load emission testing was conducted at various engine RPM with differing secondary fluid injection quantities. A portable Madur GA-21 plus exhaust gas analyser was used to measure emissions. The Madur GA-21 plus also measured averaged on road driving emissions over a repeated designated path with as similar a driving style as possible.

The vehicle underwent controlled engine load conditions of 50% and 75% load at 2,900 RPM on a 2WD Mainline chassis dynamometer. The vehicle diesel injection timing remained standard for all tests. Averaged emission test durations were 5 minute and 10 minutes. Soot testing was conducted at various operating conditions on a chassis dynamometer.

Hydrogen injection gas flow rate was constant at 95 litres per minute for all designated chassis dynamometer and low load tests.

Results

50% Load Dynamometer Testing

Secondary fluid CC-E and secondary fluid CC-M injection flow rate=75 ml per minute during all 50% load tests.

Hydrogen flow rate=95 litres per minute

The results are shown in FIG. 1.

75% Load Dynamometer Testing

Secondary fluid CC-E and secondary fluid CC-M injection flow rate=150 ml per minute during all 75% load tests.

Hydrogen flow rate=95 litres per minute

The results are shown in FIG. 2.

On Road Testing—5 and 10 min Average Testing

Secondary fluid CC-E and RO water injection flow rates were computer controlled between 0 and 150 ml per minute for all on road testing, based on engine air mass flow. The results are shown in FIG. 3 (5 min testing) and FIG. 4 (10 min testing).

Light Load Testing—LOW SPEED

Secondary fluid CC-E and secondary fluid CC-M injection flow rate=30 ml per minute during all low speed tests.

Hydrogen flow rate=95 litres per minute.

Results are shown in FIG. 5.

Light Load Testing—MEDIUM SPEED

Secondary fluid CC-E and secondary fluid CC-M injection flow rate=80 ml per minute during all medium speed tests.

Hydrogen flow rate=95 litres per minute.

Results are shown in FIG. 6.

Note: Diesel fuel rate was kept constant for all low load and low and medium speed tests. Any variance in engine RPM is considered a result of EGR flow effecting engine performance and or additional calorific value added to combustion from other fuel sources, such as the alcohol.

No appreciable difference in Soot emissions were detected across all dynamometer test results. It was noted that the test equipment operated for 30-40 seconds longer to perform the test when secondary fluid was added to the engine. It is though that the additional water vapor in the exhaust system played a role in slowing the emissions sampling rate. A different style of soot detecting device is recommended for future tests.

The standard NOx emission from an engine without the secondary fluid was 67 ppm for the 5 minute testing (FIG. 5) and 56 ppm from the 10 minute testing (FIG. 6). As can be seen from the Tables of FIGS. 5 and 6, during light load the injection of secondary fluid CC-E and CC-M both resulted in considerable reductions in NOx emissions. It is noteworthy that careful tuning of EGR flow and injection flow should be considered to balance any increase in N2O emission with reduction in CO2 emissions at this engine speed and load.

Hydrogen injection during light load with both Secondary fluid CC-E and secondary fluid CC-M showed a surprising low amount of NOx emissions. Hydrogen flow rate was constant for all tests and it is thought that the Hydrogen injection used in this testing will play a more significant role in reducing CO2 emissions at lower load. This is thought to be because of less dilution with intake air mass flow and the differential in ratio of diesel fuel injected in respect to hydrogen flow.

During on road testing NOx emission in both 5 minute and 10 minute testing showed significant reductions. It is noteworthy that the 10 minute road test showed an increase in CO2 emissions. It is thought this shows a slight discrepancy in traffic conditions or driving style. During 50% load dynamometer testing and 75% load dynamometer testing, NOx emission using both CC-E and CC-M showed a significant reduction. CC-E is particularly noteworthy in respect to N2O emissions at these engine loads.

It should be remembered that these experiments were undertaken as a "proof of concept" design, and significant improvements are expected when both systems are optimised in their design. For example, multi-port evenly distributed and timed injection will likely improve performance further. The current injection system is of the continuous flow type. It would be advantageous for both secondary fluid and hydrogen injection systems to be timed in relation to the engine induction stroke, resulting in less secondary injection fluid and hydrogen gas passing through the engine cylinder on valve overlap and into the exhaust—further improving emissions and reducing total flow quantities required, particularly at low engine RPM. It is further expected that different configuration diesel engines will perform more favourably using CC-M in respect to N2O emissions and further testing should be conducted in this area.

It is to be understood that, if any prior art publication is referred to herein, such reference does not constitute an admission that the publication forms a part of the common general knowledge in the art, in Australia or any other country.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

Any promises made in the present description should be understood to relate to some embodiments of the invention, and are not intended to be promises made about the invention as a whole. Where there are promises that are deemed to apply to all embodiments of the invention, the applicant/patentee reserves the right to later delete them from the description and does not rely on these promises for the acceptance or subsequent grant of a patent in any country.

The invention claimed is:

1. A secondary fluid for use in an internal combustion engine that burns a primary fuel, the secondary fluid comprising:

about 15 vol % to about 30 vol % of alcohol; and about 0.0025 vol % to about 0.5 vol % of a lubricity enhancer optionally comprising castor oil;

with the remainder consisting essentially of water;

wherein secondary fluid comprises a thermodynamically stable microemulsion with the water being a continuous phase.

2. The secondary fluid according to claim 1, wherein the water is degassed water.

3. The secondary fluid according to claim 1, wherein the lubricity enhancer is present in an amount in the range of from about 0.02 vol % to about 0.05 vol %.

4. The secondary fluid according to claim 1, comprising:

about 75 vol % to about 85 vol % water;

about 18 vol % to about 25 vol % of alcohol; and about 0.04 vol % of a lubricity enhancer optionally comprising castor oil.

5. The secondary fluid according to claim 1, wherein the lubricity enhancer is a triglyceride.

6. The secondary fluid according to claim 5, wherein the triglyceride is a polar triglyceride which is castor oil.

7. The secondary fluid according to claim 6, wherein the amount of castor oil is such that the specific gravity of the water/alcohol (at ambient temperature and pressure) is matched to the specific gravity of castor oil (at ambient temperature and pressure).

8. The secondary fluid according to claim 1, wherein the alcohol is selected from methanol, isopropanol, propanol, 2-butanol, n-butanol and ethanol.

9. The secondary fluid according to claim 8, wherein the alcohol is methanol.

10. A storable secondary fluid combustible in an internal combustion engine but substantially non-flammable outside the engine, said secondary fluid consisting essentially of a two-phased fluid of:

about 65 vol % to about 84.9975 vol % of water;

about 15 vol % to about 30 vol % of alcohol; and about 0.0025 vol % to about 0.5 vol % of castor oil;

which is a thermodynamically stable microemulsion with water being the continuous phase.

11. The secondary fluid according to claim 1, wherein the internal combustion engine is a diesel engine.

12. The secondary fluid according to claim 1, wherein the secondary fluid is not intended to be contactable with the primary fuel in the combustion chamber.

13. The storable secondary fluid according to claim 10, wherein the water is degassed water.

14. The secondary fluid according to claim 2, wherein the lubricity enhancer is present in an amount in the range of from about 0.02 vol % to about 0.05 vol %.

15. The storable secondary fluid according to claim 13, wherein the lubricity enhancer is present in an amount in the range of from about 0.02 vol % to about 0.05 vol %.

16. The secondary fluid according to claim 2, comprising:

about 75 vol % to about 85 vol % water;

about 18 vol % to about 25 vol % of alcohol; and about 0.04 vol % of a lubricity enhancer optionally comprising castor oil.

17. The secondary fluid according to claim 2, wherein the triglyceride is a polar triglyceride which is castor oil.

18. The storable secondary fluid according to claim 13, wherein the triglyceride is a polar triglyceride which is castor oil.

19. The secondary fluid according to claim 2, wherein the alcohol is methanol.

20. The storable secondary fluid according to claim 10, wherein the alcohol is methanol.

* * * * *